US005577566A

United States Patent [19]

Albright et al.

[11] Patent Number: 5,577,566

[45] Date of Patent: Nov. 26, 1996

[54] RELEASING TOOL

[75] Inventors: Stephen L. Albright, Houston, Tex.; Michael W. Hayes, Lafayette, La.; Jimmy L. Hollingsworth, Cypress; Guy L. McClung, III, Spring, both of Tex.

[73] Assignee: Weatherford U.S., Inc., Houston, Tex.

[21] Appl. No.: 513,147

[22] Filed: Aug. 9, 1995

[51] Int. Cl.[6] ..... E21B 17/00

[52] U.S. Cl. ..... 175/321; 166/84.1

[58] Field of Search ..... 166/178, 242.3, 166/350, 355, 360, 382, 84.4; 175/297, 296, 320, 321

[56] References Cited

U.S. PATENT DOCUMENTS

| | | | |
|---|---|---|---|
| 2,102,236 | 12/1937 | Johansen | 255/62 |
| 2,712,435 | 7/1955 | Allen | 255/28 |
| 3,033,011 | 5/1962 | Garrett | 64/11 |
| 3,073,134 | 1/1963 | Mann | 64/23 |
| 3,382,936 | 5/1968 | Galle | 175/321 |
| 3,570,598 | 3/1971 | Johnson | 166/178 |
| 3,667,252 | 6/1972 | Nelson | 64/23.5 |
| 3,735,827 | 5/1973 | Berryman | 175/296 |
| 3,746,329 | 7/1973 | Galle | 267/125 |
| 3,771,603 | 11/1973 | Crowe | 166/375 |
| 3,797,591 | 3/1974 | Berryman | 175/296 |
| 3,917,006 | 11/1975 | Kellner | 175/5 |
| 3,964,305 | 6/1976 | Wray et al. | 166/321 X |
| 3,965,980 | 6/1976 | Williamson | 166/224 R |
| 3,991,837 | 11/1976 | Crickmer | 175/27 |
| 4,055,338 | 10/1977 | Dyer | 267/125 |
| 4,111,271 | 9/1978 | Perkins | 175/297 |
| 4,139,994 | 2/1979 | Alther | 64/23 |
| 5,348,351 | 9/1994 | LaFleur et al. | 285/110 |

OTHER PUBLICATIONS

"LaFleur Petroleum Services, Inc. Autoseal Circulating Head," LaFleur Petroleum Services, Inc., 1992.

"Over–the–Collar Casing Circulating Head," LaFleur Petroleum Services, Inc., 1990.

"Completion Solutions From TIW—1990—91 General Catalog," Texas Iron Works, Inc., 1989.

*Primary Examiner*—Frank Tsay

*Attorney, Agent, or Firm*—Guy McClung

[57] ABSTRACT

A new tool has been developed for, in one aspect, facilitating release of a tubular string coupled between a travelling block and elevators with insufficient clearance to release elevator slips in order to remove the tubular. In one aspect the releasing tool is effectively shortened permitting release of the elevators. Such shortening is effected by releasing an expansion sub and piston within the tool for relative movement with respect to other parts of the tool. Initially the expansion sub and piston are held in place by fluid in a first chamber. Movement of fluid from the first chamber and movement of fluid into a second chamber housing the piston results in piston movement (and movement of the expansion sub which is secured to the piston) to effectively shorten the tool. In one aspect the fluid moves in a closed loop between the chambers and no fluid is expelled to the environment. In another aspect only one fluid chamber is used.

10 Claims, 2 Drawing Sheets

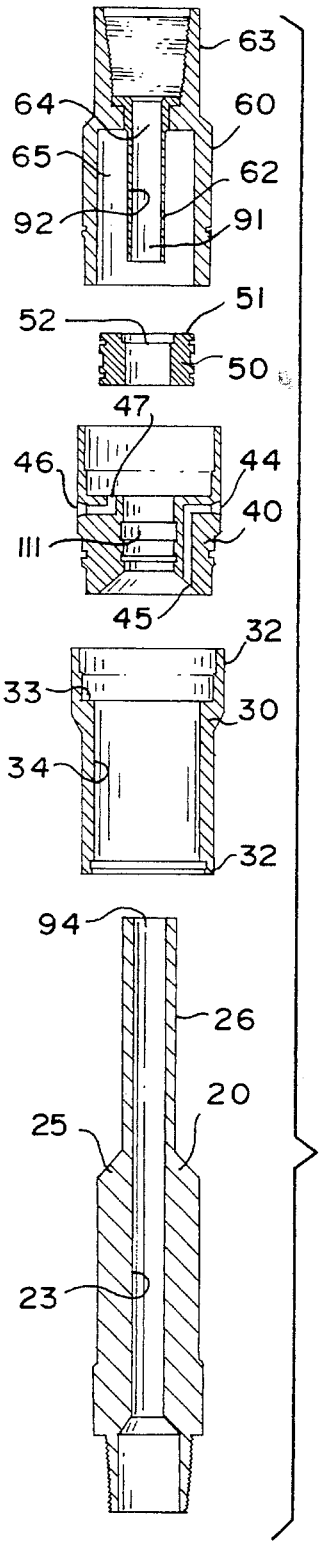
FIG. 3
FIG. 4
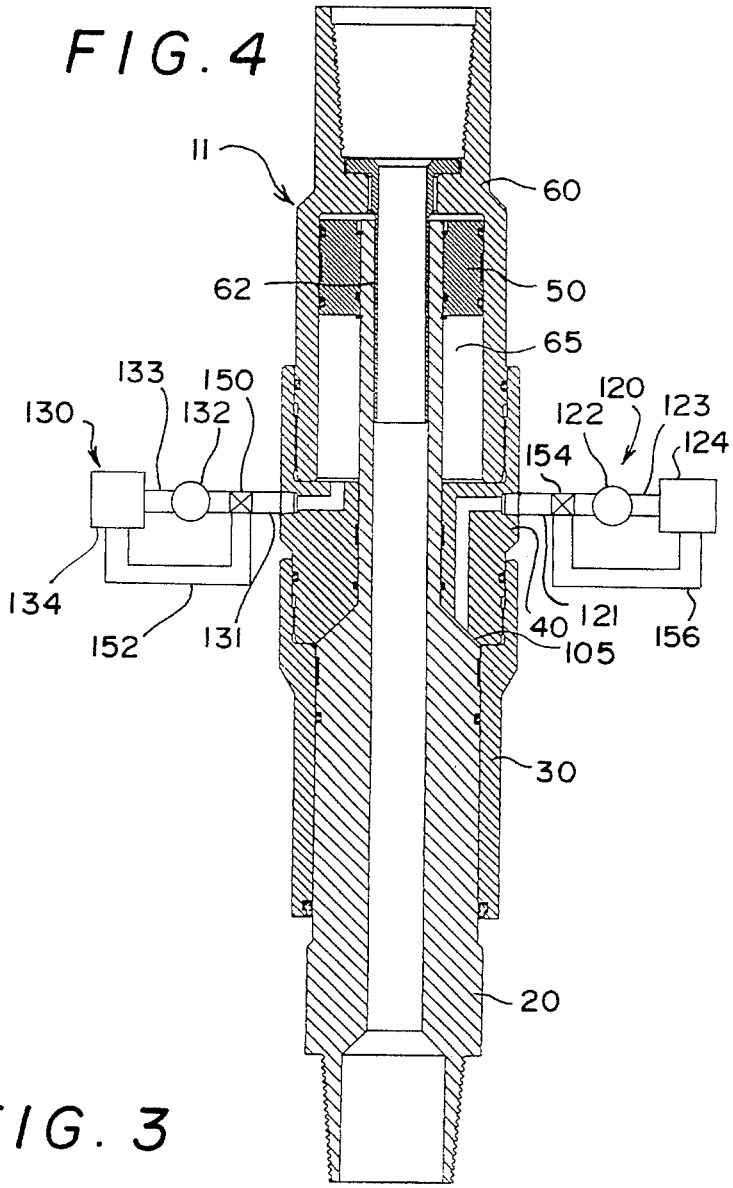
FIG. 5
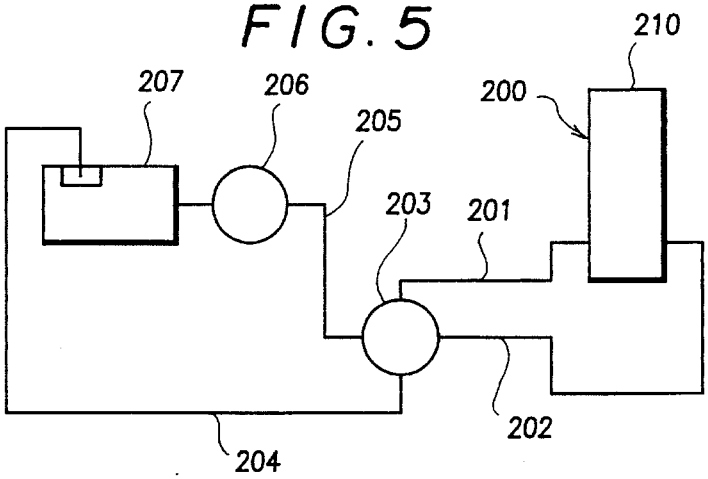

RELEASING TOOL

BACKGROUND OF THE INVENTION

1. Field Of The Invention

The present invention is directed to a tool for facilitating the release of elevators connected to a tubular and used with a circulating head which has been lowered too far down onto the tubular; to a tool for providing length adjustment so that elevators can be released from a tubular; to methods for using such tools; in one aspect to such a tool which employs hydraulic fluid.

2. Description of Related Art

A circulating head (e.g. as disclosed in U.S. Pat. Nos. 5,152,554; 5,282,653; and 5,348,351) is used to provide mud flow into casing as casing is being run into a wellbore. In the past such a head has been used with a top drive and mounted below the top drive. In the event that the head is lowered too far down onto a piece of casing, it is not possible to release elevators supporting tubulars below the head unless the top drive is rotated to provide for limited movement or slack in a manual safety release sub below the top drive. With non-top drive rigs there is no upper prime mover to rotate the manual safety release sub and, therefore, such systems are not desirable for use with non-top drive rigs. One prior art method opened a vent to release grease from the head.

SUMMARY OF THE PRESENT INVENTION

The present invention, in certain embodiments, provides a tool which may be selectively lengthened and shortened. Such length adjustment makes it possible to release elevators supporting the casing, e.g. in the event it is necessary to facilitate the release of a tubular string coupled between a rig's travelling block and elevators with insufficient clearance to release the elevator slips in order to remove the tubular. Such a tool may also be used between a top drive and a circulating head to provide such length adjustment.

In one embodiment such a tool has a body with a piston movably mounted in a first chamber therein. The piston is secured to an expansion sub which has a portion movably mounted in a second chamber. Initially fluid (e.g. air or hydraulic fluid) is provided in the second chamber which maintains the position of the expansion sub. The tool is interconnectible between a top drive and circulating head or between such a head and a swivel and travelling block of a non-top drive rig.

In the event that movement of the casing string is stopped (e.g. a bridge is encountered), and/or the travelling block is lowered too far down (so that the circulating head is lowered too far down on the casing) the tool according to this invention provides length adjustment by movement of the fluid from the second chamber into the first chamber raising the piston, thereby providing some degree of freedom or slack so that elevators supporting the casing can be released.

In one embodiment a first flow port in communication with the first chamber is also in fluid communication via a flow line with a second flow port which communicates with the second chamber. A valve controls fluid flow in the flow line. Opening the valve permits fluid to flow from the second chamber to the first chamber (or vice versa) providing for the length adjustment of the tool to permit release of the elevators. The first chamber may be above the second chamber, or vice versa; i.e. the tool may be used with either end up. In one aspect the downward force of items above the second chamber forces fluid from the second chamber into the first chamber. The valve may be manually operated by a person on the rig floor or, with appropriate wiring, and/or flow lines, and actuators (electric, hydraulic, or pneumatic) remotely operated by any personnel. Such a tool, when used with non-top drive systems, has a circulating sub mounted above it through which mud is circulated to the circulating head through the tool according to the present invention. It is within the scope of this invention to use any fluid transfer device for moving fluid between the upper and lower chambers.

In another aspect each chamber has its own fluid supply system, pump, and fluid reservoir.

It is, therefore, an object of at least certain preferred embodiments of the present invention to provide:

New, useful, unique, efficient, nonobvious devices and methods for a length adjustable tool for facilitating release of elevators from a string of tubular members;

Such a tool useful with a circulating head as disclosed in U.S. Pat. No. 5,348,351;

Such a tool useful with both top drive rigs and non-top drive rigs;

Such a tool which, in one aspect, has an enclosed fluid loop in which fluid flows from one chamber to another without exiting the tool; and New useful, nonobvious, efficient, and effective methods for using such tools.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 3 is an exploded view of the tool of FIG. 1.

FIG. 4 is a side cross-sectional view of a tool according to the present invention.

FIG. 5 is a schematic view of a system according to the present invention.

DESCRIPTION OF EMBODIMENTS PREFERRED AT THE TIME OF FILING FOR THIS PATENT

Figure 1:
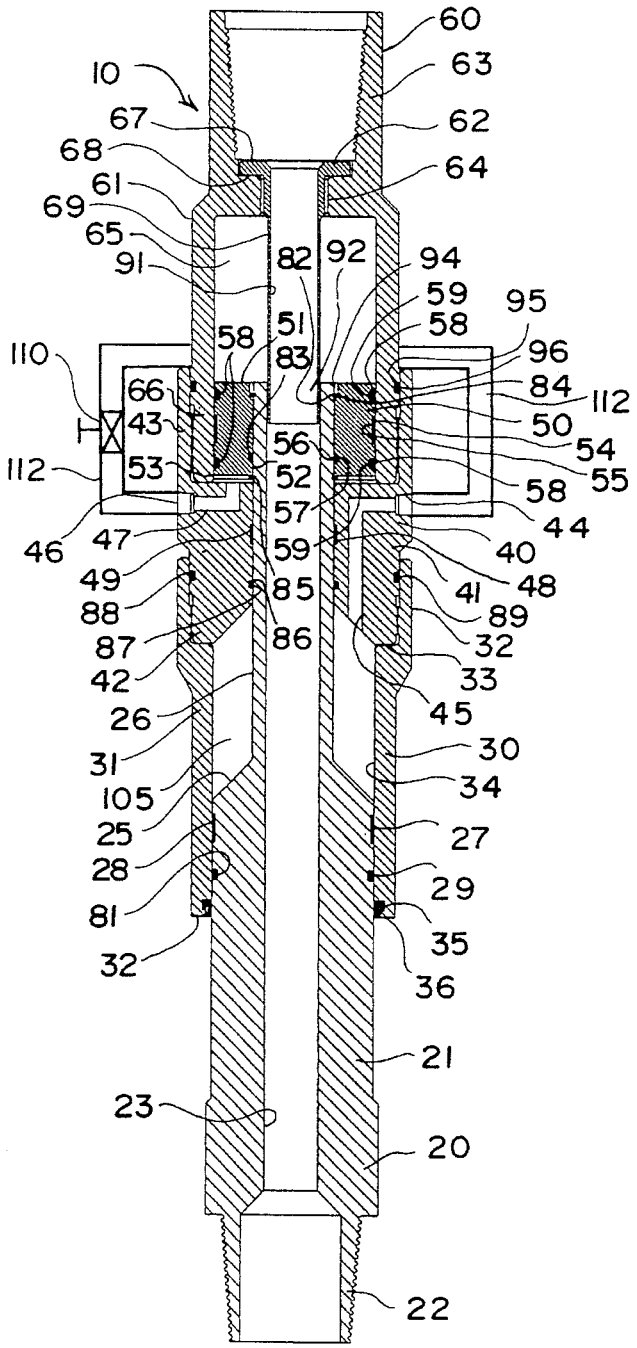
FIG. 1 is a side cross-sectional view of a tool according to the present invention.

Referring now to FIG. 1, a tool 10 according to the present invention has an expansion sub 20, an outer sleeve 30, a separator sub 40, a piston 50, and an upper sub 60 with a flow director 62.

The expansion sub 20 has a body 21; a lower exteriorly-threaded end 22 for mating with another tool or device (e.g. but not limited to a mud circulating head); a central fluid flow bore 23 through the body 21; an upper surface 25; and a nose 26. A wear ring 27 is mounted in a recess 28 in the body 21. A seal 29 is mounted in a recess 81 in the body 21 to seal the interface between the expansion sub 20 and the outer sleeve 30. The outer sleeve 30 has an end 32. Snap ring recesses 82 and 83 receive and hold snap rings 84 and 85 as described below.

The outer sleeve 30 has a body 31 with an upper interiorly threaded end 32. An inner shoulder 33 abuts a lower end 42 of the separator sub 40. A portion of the body 21 and nose 26 of the expansion sub 20 move in an inner bore 34 of the outer sleeve 30. A wiper 35 in a recess 36 wipes the outer surface of the expansion sub 20.

The separator sub 40 has a body 41; a lower threaded end 42 which mates with the upper interiorly threaded end 32 of the outer sleeve 30; a central flow bore 111; and an tipper interiorly threaded end 43 which mates with a lower end 66 (exteriorly threaded) of the upper sub 60.

A flow port 44 through the body 41 communicates with a flow line 45 which communicates with the interior of the outer sleeve 30. A flow port 46 communicates with a flow line 47 that communicates with an interior chamber of the upper sub 60. A wear ring 48 in a recess 49 abuts the nose 26 of the expansion sub 20. A seal 86 in a recess 87 seals the interface between the nose 26 and a bore 87 of the separator sub 40. A seal 88 in a recess 89 seals the interface between the separator sub 40 and the outer sleeve 30.

The upper sub 60 has a body 61; an upper interiorly-threaded end 63; a central flow bore 64; and a chamber 65. A flow director 62 has an upper shoulder 67 which rests on a shoulder 68 of the upper sub 60. A cylindrical pipe portion 69 of the flow director 62 has an inner fluid bore 91. A lower end 92 of the pipe portion 69 projects into an upper end 94 of the flow bore 23 of the expansion sub 20. The upper end 94 of the expansion sub 20 moves upwardly on and around the lower end 92 of the flow director 62. Thus internal parts of the upper sub 60 and the piston 50 are not exposed to fluids (e.g. corrosive or erosive fluids) flowing through the upper sub and down through the expansion sub. A seal 95 in a recess 96 seals the interface between the upper sub 60 and the separator sub 40.

The piston 50 has a body 51 with a central bore 52. The piston 50 is secured to the nose 26 of the expansion sub 20 with the snap ring 84, part of which resides in a recess 101 in the piston body 51 and by the snap ring 85 which abuts a lower end 53 of the piston 50. A wear ring 54 in a recess 55 abuts an interior surface of the chamber 65 of the upper sub 60. A seal 56 in a recess 57 seals the interface between the piston body 51 and the nose 26 of the expansion sub 20. Seals 58 in recesses 59 seal the interface between piston body 51 and the interior of the chamber 65 of the upper sub 60. In one aspect the flow director is not secured in a fluid tight manner in the upper sub 60 so that fluid (e.g. air or drilling fluid) above the piston 50 may escape from the upper chamber 65 as the piston 50 moves upwardly therein. In another aspect the flow director is sealed fluid-tight in the upper sub 60 and a fluid purge device or vent is provided through the wall of the upper sub 60. In another aspect there is no fluid in the upper chamber.

In one method according to the present invention, the tool 10 as shown in FIG. 1 is positioned above a circulating head. The head is then applied to an end of a piece of casing. As shown in FIG. 1, the piston 50 is at the bottom of the chamber 65 in the upper sub 60 and, therefore, the expansion sub 20 is at the lower limit of its travel with respect to the outer sleeve 30 and the separator sub 40. The piston 50 and the expansion sub 20 are maintained in this position by the presence of fluid (in one aspect hydraulic fluid) captured in a lower chamber 105 (defined by the surface 25 of the expansion sub 20, a portion of the outer surface of the nose 26, a portion of the inner surface of the outer sleeve 30, and a portion of the surface of the lower end 42 of the separator sub 40) by a closed valve 110.

Figure 2:
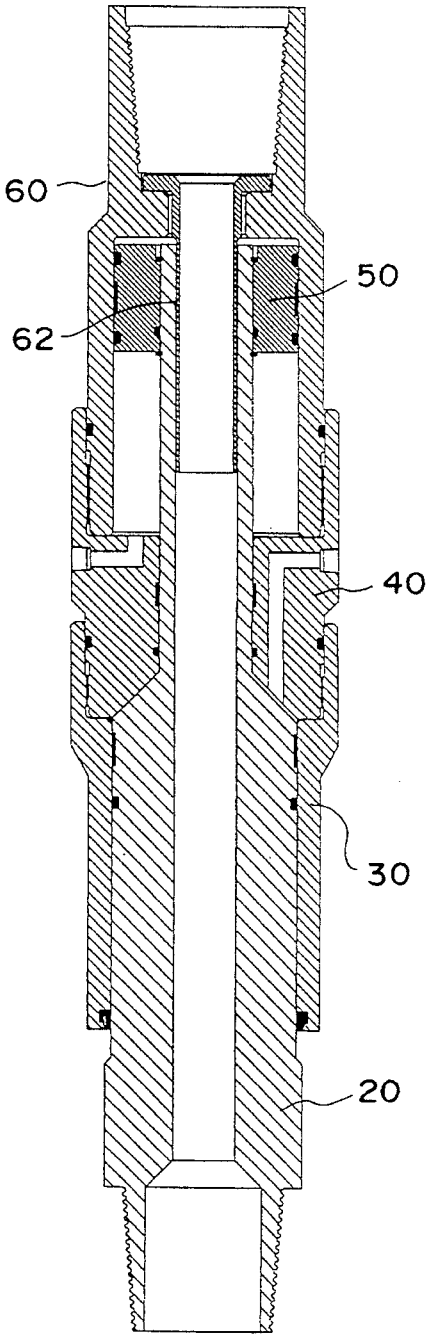
FIG. 2 is a side cross-sectional view of the tool of FIG. 1.

In the event that it becomes necessary to shorten the tool, a valve 110 controlling flow in a flow line 112 is opened. The flow line 112 provides for fluid communication between the lower chamber 105 and the upper chamber 65. Preferably the lower chamber 105, the flow line 112, and any small space in the upper chamber 65 beneath the piston 50 are filled with fluid, e.g. pneumatic or hydraulic fluid. Downward force of the parts of the tool 10 above the expansion sub 20 pushes the fluid in the lower chamber 105 out from the chamber, into the flow line 112, and into flow port 46. This fluid pushes up on the piston 50 and the piston 50 and expansion sub 20 move with respect to the other parts of the tool 10. This effectively shortens the overall length of the tool 10 (as shown in FIG. 2) and provides a range of movement for a travelling block above the tool, allowing the travelling block to be lowered and elevators supporting the tubulars to be released. Due to the series of flow bores through each part of the tool 10, mud or other fluid is permitted to circulate through the tool 10 at all times. If desired a pump may be used in the flow line 112. The tool is returned to its initial lengthened position by opening the valve 110, disengaging the elevators, and lifting the traveling block to freely suspend the circulating head below the block. The combined weight of circulating head, the sub 20 and other connecting parts acts to force fluid from the upper chamber 65 through the port 46 and line 112 into the lower chamber 105. When fluid transfer is complete, the valve 110 is closed and the tool is again ready for the next operation.

FIG. 4 illustrates a tool 11 which is like the tool 10 with similar parts bearing the same identifying numerals. There is no flow line 112 and no valve 110 in the tool 11. Instead, the lower chamber 105 has its own fluid supply system 120 with a flow line 121, pump 122, flow line 123, and fluid reservoir 124; and the upper chamber 65 has its own fluid supply system 130 with a flow line 131, pump 132, flow line 133 and fluid reservoir 134. A fluid flow line 152 bypasses the pump 130 and a three-way valve 150 controls flow in the line 131 and the line 152, permitting no flow, flow to the pump 132 or flow through the line 152. Similarly a flow line 156 by passes the pump 122 and a three-way valve 154 controls flow in the line 121 and the line 156. In another aspect, the lower chamber 105 is eliminated and the flow lines 121, 123, 156, pump 122 and reservoir 124 are eliminated; i.e., this embodiment uses only one external reservoir and one internal chamber to move the piston.

FIG. 5 illustrates a system 200 according to the present invention which has a tool 210 (like the tool of FIG. 1). A fluid flow line 201 connects an upper chamber (not shown like the chamber 65) of the tool 210 to a valve 203. A fluid flow line 202 connects a lower chamber (not shown, like the lower chamber 105) to the valve 203. A pump 206 in a line 205 pumps fluid to and from a fluid reservoir 207, through the valve 203 (when it is open) and through the line 201. With the valve 203 in another position, the pump 206 pumps fluid from the reservoir 207, through a line 204, through the valve 203, and to the line 202. In another position the valve 203 closes both lines 201 and 202 to flow. By moving fluid from one chamber (upper or lower) to the other (lower or upper), the tool 210 functions as does the tool of FIG. 1.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A selectively length adjustable tool for use with a rig system for running a string of tubulars including a circulating head, the tool comprising a body with a first end, a second end, and a body fluid flow bore therethrough from the first end to the second end, the body having a first fluid chamber and a second fluid chamber, a piston member with a first piston end and a second piston end, the second piston end initially projecting out from and extending from the second end of the body an initial distance, a first piston portion at the first piston end and a second portion at the second piston end, the second portion interconnected to the second portion by a middle member, a piston flow bore extending from the first piston end, through the middle member, to the second piston end for wellbore fluid flow through the tool, the first piston portion movably disposed in the first fluid chamber and the second portion movably disposed in the second fluid chamber, so that expulsion of fluid from the second fluid chamber and introduction of fluid into the first fluid chamber effects movement of the piston member with respect to the body moving the first piston end in the first fluid chamber toward the first end of the body and moving a portion of the second piston end into the second end of the body thereby effectively shortening the length of the tool.

2. The tool of claim 1 wherein the first fluid chamber is an upper fluid chamber, the second fluid chamber is a lower fluid chamber spaced apart from and beneath the first fluid chamber, and introduction of the fluid into the upper fluid chamber from the lower fluid chamber effects upward movement of the piston member.

3. The tool of claim 1 wherein the first piston end is a top piston end, the second piston end is a bottom piston end beneath the top piston end, the first piston portion is an upper piston portion, and the second piston portion is a lower piston portion below the first piston portion.

4. The tool of claim 1 further comprising a conduit between the first fluid chamber and the second fluid chamber so that fluid expelled from the second piston chamber flows in the conduit to the first piston chamber without exiting the tool.

5. The tool of claim 1 further comprising the first end of the body member is a top end and the second end of the body member is a bottom end, and a flow director in the top end of the body with a pipe portion extending down into the piston flow bore so that wellbore fluid flowing through the body fluid flow bore of the body member is isolated from an exterior of the piston member and from an interior of the top end of the body member.

6. The tool of claim 1 wherein the first fluid chamber is an upper fluid chamber, the second fluid chamber is a lower fluid chamber spaced apart from and beneath the first fluid chamber, and introduction of the fluid into the lower fluid chamber from the upper fluid chamber effects movement of the piston member.

7. The tool of claim 1 wherein the first piston end is a top piston end, the second piston end is a bottom piston end beneath the top piston end, the first piston portion is an upper piston portion, and the second piston portion is a lower piston portion below the first piston portion.

8. The tool of claim 1 further comprising a conduit between the first fluid chamber and the second fluid chamber so that fluid expelled from the first piston chamber flows in the conduit to the second piston chamber without exiting the tool.

9. The tool of claim 1 further comprising the first end of the body member is a top end and the second end of the body member is a bottom end, and a flow director in the top end of the body with a pipe portion extending down into the piston flow bore so that wellbore fluid flowing through the body fluid flow bore of the body member is isolated from an exterior of the piston member and from an interior of the top end of the body member.

10. A selectively length adjustable tool for use with a rig system for running a string of tubulars including a circulating head, the tool comprising a body with a first end, a second end, and a body fluid flow bore therethrough from the first end to the second end, the body having a first fluid chamber and a second fluid chamber, a piston member with a first piston end and a second piston end, the second piston end initially projecting out from and extending from the second end of the body an initial distance, a first piston portion at the first piston end and a second portion at the second piston end, the second portion interconnected to the second portion by a middle member, a piston flow bore extending from the first piston end, through the middle member, to the second piston end for wellbore fluid flow through the tool, the first piston portion movably disposed in the first fluid chamber and the second portion movably disposed in the second fluid chamber, so that expulsion of fluid from the first fluid chamber and introduction of fluid into the second fluid chamber effects movement of the piston member with respect to the body moving the first piston end in the first fluid chamber away from the first end of the body and moving a portion of the second piston end out from the second end of the body thereby effectively lengthening the length of the tool.

* * * * *